US009402436B2

(12) United States Patent
Blowers

(10) Patent No.: US 9,402,436 B2
(45) Date of Patent: Aug. 2, 2016

(54) CUSTOMIZABLE REPLACEMENT STRAP CONVERTER SYSTEM FOR FLIP FLOP SANDALS

(71) Applicant: Kimberly Blowers, Las Vegas, NV (US)

(72) Inventor: Kimberly Blowers, Las Vegas, NV (US)

( * ) Notice: Subject to any disclaimer, the term of this patent is extended or adjusted under 35 U.S.C. 154(b) by 562 days.

(21) Appl. No.: 13/923,240

(22) Filed: Jun. 20, 2013

(65) Prior Publication Data

US 2013/0340285 A1 Dec. 26, 2013

Related U.S. Application Data

(60) Provisional application No. 61/662,032, filed on Jun. 20, 2012.

(51) Int. Cl.

| | |
|---|---|
| ***A43B 3/10*** | (2006.01) |
| ***A43B 3/24*** | (2006.01) |
| ***A43B 1/00*** | (2006.01) |
| ***A43B 3/00*** | (2006.01) |
| ***A43B 3/12*** | (2006.01) |
| ***A43B 23/24*** | (2006.01) |

(52) U.S. Cl.

CPC ..... *A43B 3/244* (2013.01); *A43B 1/0054* (2013.01); *A43B 3/0078* (2013.01); *A43B 3/103* (2013.01); *A43B 3/122* (2013.01); *A43B 23/24* (2013.01)

(58) Field of Classification Search

CPC ..... A43B 3/0078; A43B 3/244; A43B 3/248; A43B 3/103; A43B 3/10; A43B 3/122; A43B 3/12; A43B 1/0054

USPC ..... 36/11.5, 100, 101

See application file for complete search history.

(56) References Cited

U.S. PATENT DOCUMENTS

| | | | | |
|---|---|---|---|---|
| 3,928,927 | A * | 12/1975 | Brown | A43B 3/122 12/142 S |
| 3,978,596 | A * | 9/1976 | Brown | A43B 3/122 12/142 S |
| 8,020,319 | B1 * | 9/2011 | Mohaupt | A43B 3/122 36/101 |
| D732,807 | S * | 6/2015 | Collins | D2/916 |
| 2007/0245597 | A1 * | 10/2007 | Krutilek | A43B 3/103 36/101 |
| 2013/0091732 | A1 * | 4/2013 | Mendoza | A43B 3/0078 36/100 |
| 2014/0165426 | A1 * | 6/2014 | Chapin | A43B 3/103 36/100 |

FOREIGN PATENT DOCUMENTS

| | | | | |
|---|---|---|---|---|
| FR | 2973655 | A1 * | 10/2012 | A43B 3/122 |

* cited by examiner

*Primary Examiner* — Ted Kavanaugh

(57) ABSTRACT

A customizable replacement strap converter system for flip flop sandals provides the ability to create a customized strap arrangement for a pair of flip flop sandals. Converter pegs are inserted into a stock sandal sole after the stock strap arrangement has been removed, providing a number of cord loops through which a plurality of straps may be threaded. A strap tie ring and a decorative embellishment may also be incorporated for added aesthetic appeal.

6 Claims, 6 Drawing Sheets

CUSTOMIZABLE REPLACEMENT STRAP CONVERTER SYSTEM FOR FLIP FLOP SANDALS

The current application claims a priority to the U.S. Provisional Patent application Ser. No. 61/662,032 filed on Jun. 20, 2012.

FIELD OF THE INVENTION

The present invention relates generally to footwear. More particularly, the present invention relates to a system for converting standard flip-flop sandals into customizable lace-up sandals.

BACKGROUND OF THE INVENTION

Footwear refers to garments worn on the feet, primarily for protection against the environment and for fashion. Many different styles and mindsets regarding footwear have existed over many centuries and across many cultures. Some ancient cultures such as the Egyptians, Hindu and Greeks did not regard footwear as an essential garment and often went barefoot, though the Egyptians and Hindus were known to occasionally don ornamental footwear, such as a sole-less sandal known as a "Cleopatra." Other cultures, such as the Romans, considered footwear as visual signs of social and economic status and power, while going about barefoot was an indicator of poverty on the level of slaves and peasants.

Sandals are an open type of outdoor footwear, consisting of a sole held to the wearer's foot by straps passing over the instep and occasionally over the ankle. Sandals may take many different forms but the common understanding is that a sandal leaves a large portion of the upper foot exposed, particularly the toes. Conventional foot sandals ordinarily include a platform with straps extending across the platform and permanently secured within the platform structure. The foot is then slipped into the strap so as to provide a means of holding the foot to the platform. Sandals have been very popular for many years, and are widely used indoors and outdoors, usually in warmer weather and climates. During the past decades, sandals have been increasingly considered a popular design accessory, so that a pair of sandals is selected by the user to blend well aesthetically with other clothing to be worn by the user, coordinating the "look" of the sandals with those clothes. Sandals may, however, be expensive, and when styles change, previously purchased sandals become obsolete, and the user may feel the need to purchase a new pair to keep up with the latest style trend.

Many different types of sandals exist, including clogs, fisherman sandals, geta, Grecian sandals, and thong sandals or "flip-flops." Flip flops are one of the most common types of sandals, where two ends of a Y-shaped strap are attached to the sole of the sandal on the opposite sides of the sole where a wearer's foot would rest, with the two ends intersecting at a thong or toe piece extending from the sole for placement between the big or first toe and the second toe of the wearer's feet. This configuration of sandal straps contributes to the common name of "flip-flops" due to the slapping of the sole against the heel that occurs while walking.

It has been proposed in the past to manufacture sandals and shoes with interchangeable and removable elements, but these prior art devices are normally quite complicated and difficult to provide for the interlocking of the elements. The present invention provides for a method to customize thong sandals which is very simple and provides for a method to quickly and easily replace the original straps with any configuration of straps, laces, embellishments, or charms the user may desire.

It is therefore an object of the present invention to provide an apparatus which allows the user to replace the Y-shaped strap of a typical pair of thong or flip-flop sandals with custom straps laces, embellishments, charms or other accessories.

DETAIL DESCRIPTIONS OF THE INVENTION

All illustrations of the drawings are for the purpose of describing selected versions of the present invention and are not intended to limit the scope of the present invention.

The present invention is an apparatus for the conversion of standard Y-strap sandals or thongs into customizable lace-up sandals. The present invention generally comprises a plurality of converter pegs 1 and a strap arrangement 2. The plurality of converter pegs 1 and the strap arrangement 2 are installed onto a sandal sole 3 from a pair of pre-existing flip-flop sandals.

Figure 1:
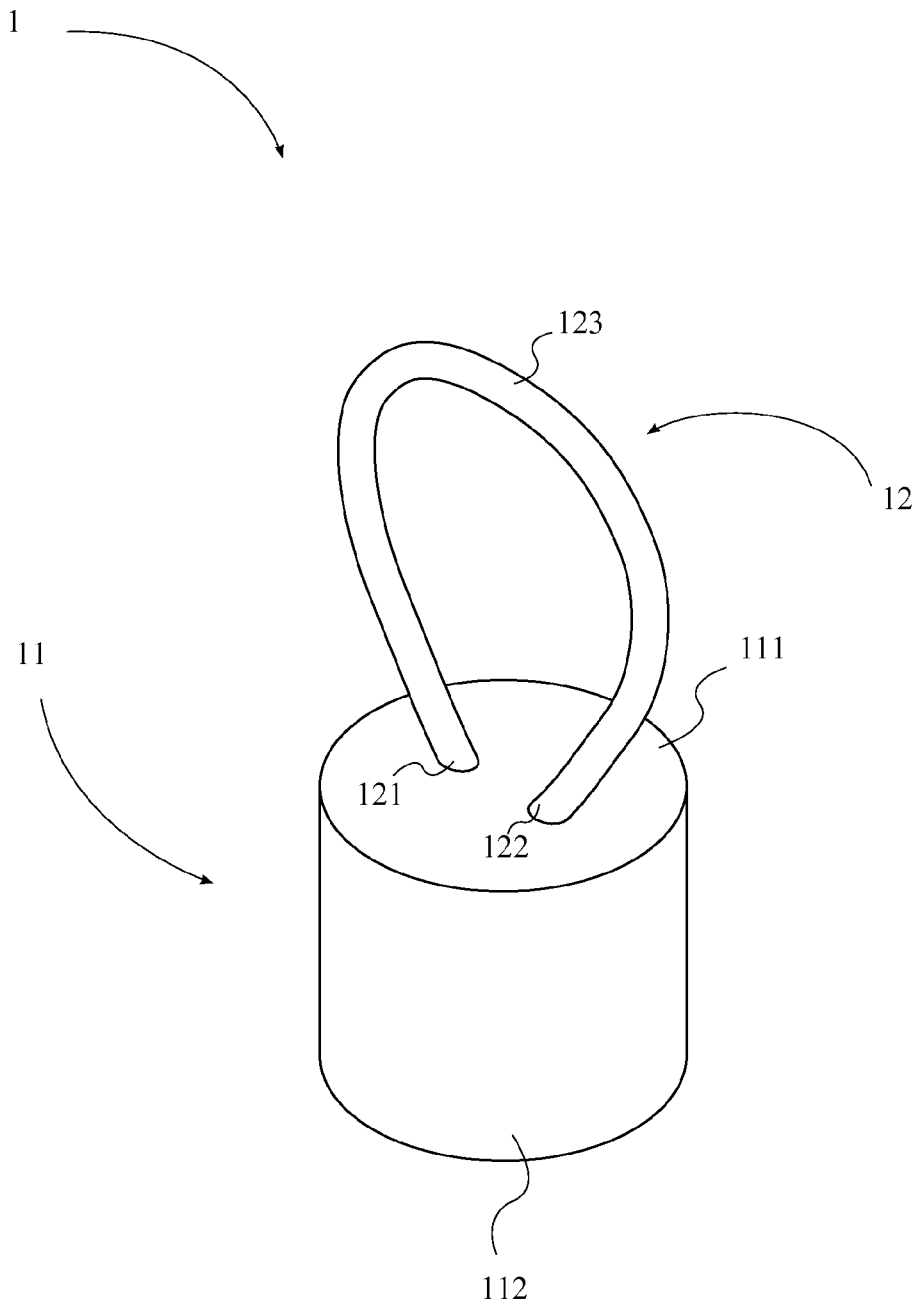
FIG. 1 is a perspective view of one of the converter pegs.

Referring to FIG. 1, each of the plurality of converter pegs 1 comprises a top face 111, a peg portion 112, and a cord loop 12. The peg portion 112 and the top face 111 constitute a converter peg body 11. In the preferred embodiment of the present invention, the converter peg body 11 is made from injection molded plastic or another relatively stiff polymer. The cord loop 12 is made from a soft, flexible plastic, nylon or other polymer, various types of fabric or another appropriate material that is soft, pliable, comfortable and safe for extended skin contact. Peg portion 112 is cylindrical.

The top face 111 is positioned on the peg portion 112, wherein the top face 111 and the peg portion 112 are concentrically positioned with each other. The peg portion 112 is positioned adjacent to the top face 111 opposite the loop cord. A perimeter for the top face 111 has an equal diameter to a first diameter of the peg portion 112.

The cord loop 12 is perpendicularly attached to the top face 111 opposite the peg portion 112. The cord loop 12 comprises a first loop end 121, a second loop end 122, and a medial loop portion 123. The first loop end 121 and the second loop end 122 are positioned adjacent to each other, and are attached to the top face 111. The medial loop portion 123 is positioned opposite the first loop end 121 and the second loop end 122.

In the preferred embodiment of the present invention, the converter peg body 11 and the cord loop 12 are manufactured such that the cord loop 12 is permanently attached to the converter peg body 11, wherein the cord loop 12 is oriented perpendicular to the converter peg body 11. In an alternate embodiment of the present invention, a converter peg is assembled from a length of cord that is attached at its ends to make a cord end junction by tying a knot, melting the ends together, or affixing them together with adhesive or similar means, and pushing the cord loop 12 through a cord aperture in the converter peg body 11 smaller than the cord end junction. In another embodiment, the cord end junction of the cord loop 12 are prevented from passing through the cord aperture by affixing an o-ring, split washer, crimp cover, or any combination of o-rings, split washers and crimp covers between the cord end junction and the cord aperture.

Figure 2:
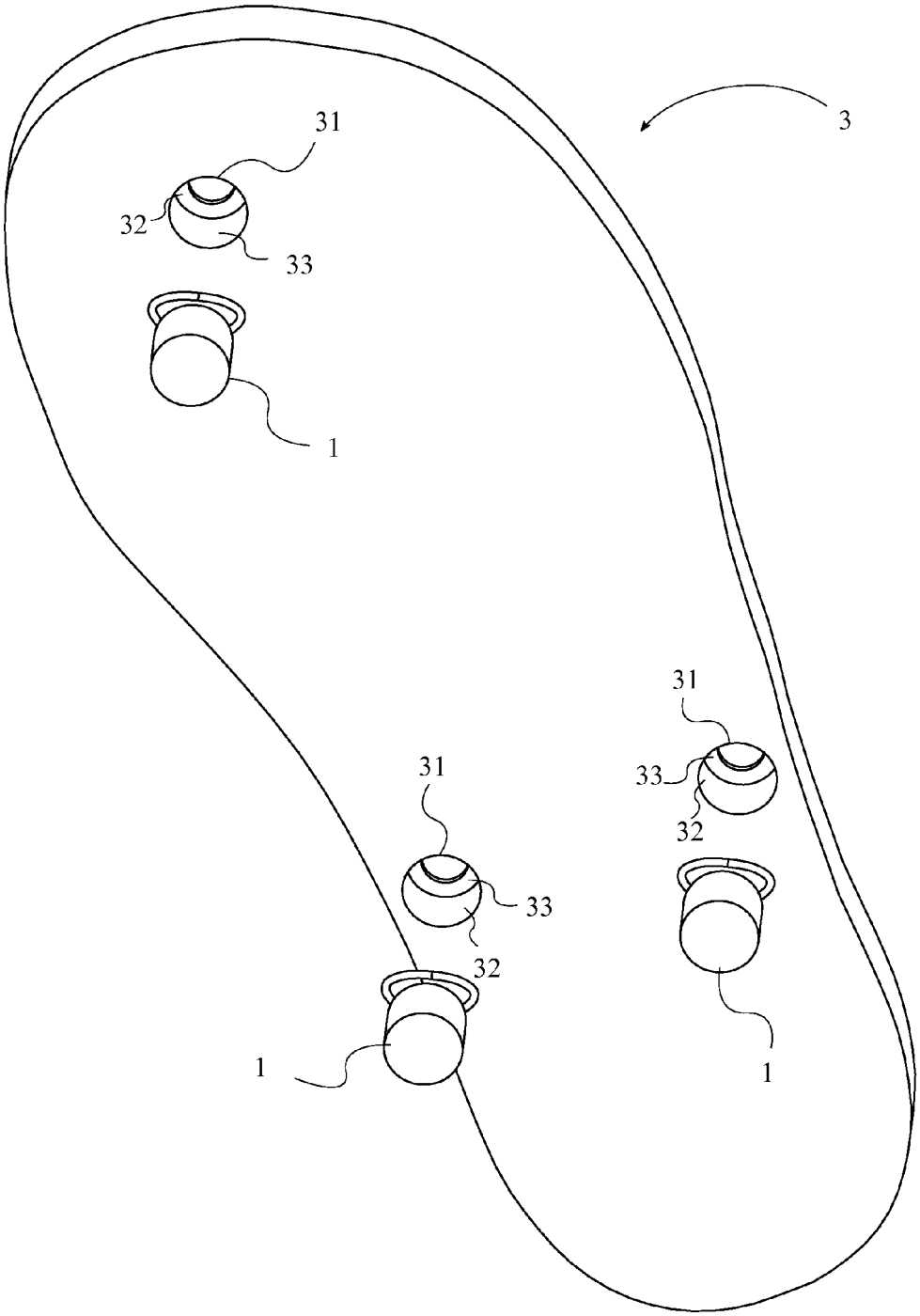
FIG. 2 is an exploded lower perspective view of the sandal sole and the plurality of converter pegs.
Figure 3:
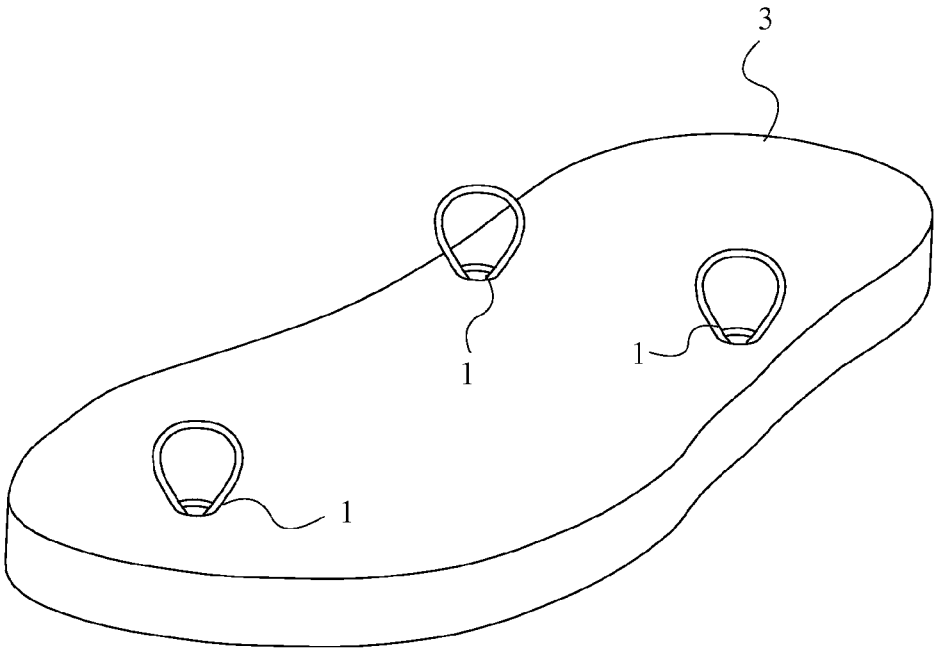
FIG. 3 is a perspective view of the sandal sole with the plurality of converter pegs installed.

Referring to FIGS. 2-3, the sandal sole 3 comprises a plurality of peg apertures 31. The sandal sole 3 may be from an existing flip-flop sandal from which pre-installed straps have been removed or a standalone sandal sole 3. In the preferred embodiment, each of the plurality of peg apertures 31 has typical dimensions of flip-flop sandal soles. In other embodiments, each of the plurality of peg apertures 31 has atypical dimensions. A quantity of peg apertures for the plurality of peg apertures 31 is equal to a quantity of converter pegs for the plurality of converter pegs 1. The plurality of peg apertures 31 traverses through the sandal sole 3, wherein the plurality of peg apertures 31 is positioned around the sandal sole 3 according to a typical flip-flop sandal arrangement. In the typical flip-flop sandal arrangement, a first peg aperture from the plurality of peg apertures 31 is positioned approximately between a user's first toe and second toe, and a second peg aperture and a third peg aperture from the plurality of peg apertures 31 are positioned opposite each other across the instep area of a user's foot. Each of the plurality of peg apertures 31 comprises a first aperture portion 32 and a second aperture portion 33. The first aperture portion 32 and the second aperture portion 33 are concentrically positioned with each other and are positioned adjacent to each other. A first aperture diameter for the first aperture portion 32 is larger than a second aperture diameter for the second aperture portion 33, forming a peg aperture T shape.

The plurality of converter pegs 1 is removably inserted into the plurality of peg apertures 31. The converter peg body 11 and each of the plurality of peg apertures 31 have approximately equal dimensions, such that the converter peg body 11 may be removably inserted into one of the plurality of peg apertures 31 by applying a small force, and friction between the converter peg body 11 and the one of the plurality of peg apertures 31 prevents the converter body from accidentally becoming dislodged from the one of the plurality of peg apertures 31. The second aperture portion 33 blocks the plurality of converter pegs 1 from being pulled completely through the sandal sole 3 during use. Preferably, when the plurality of converter pegs 1 is inserted into the plurality of peg apertures 31, a lower extremities of the converter peg body 11 of the plurality of converter pegs 1 is flush with a bottom surface of the sandal sole 3.

Figure 4:
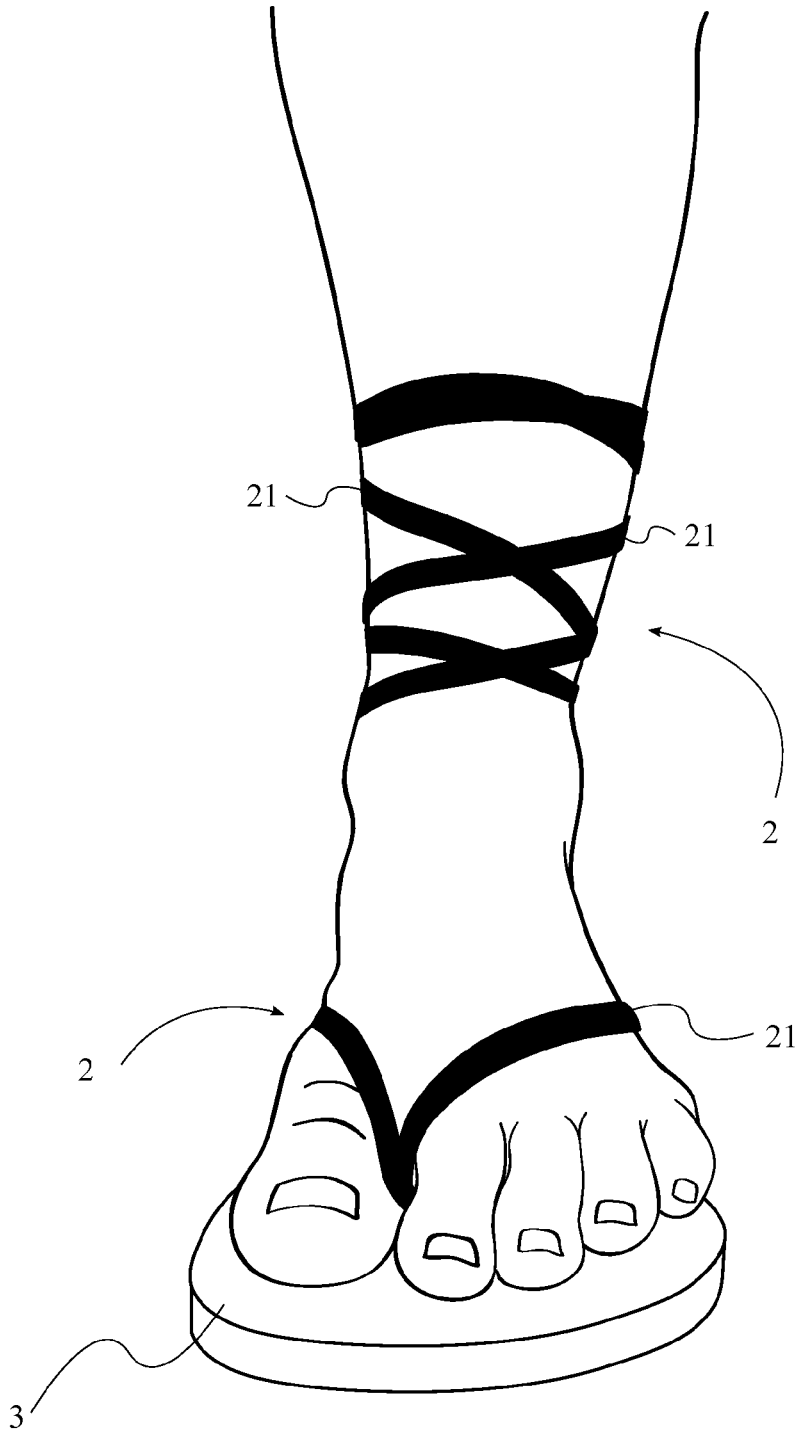
FIG. 4 is a front view of the present invention in use having a strap arrangement using only the plurality of straps.
Figure 5:
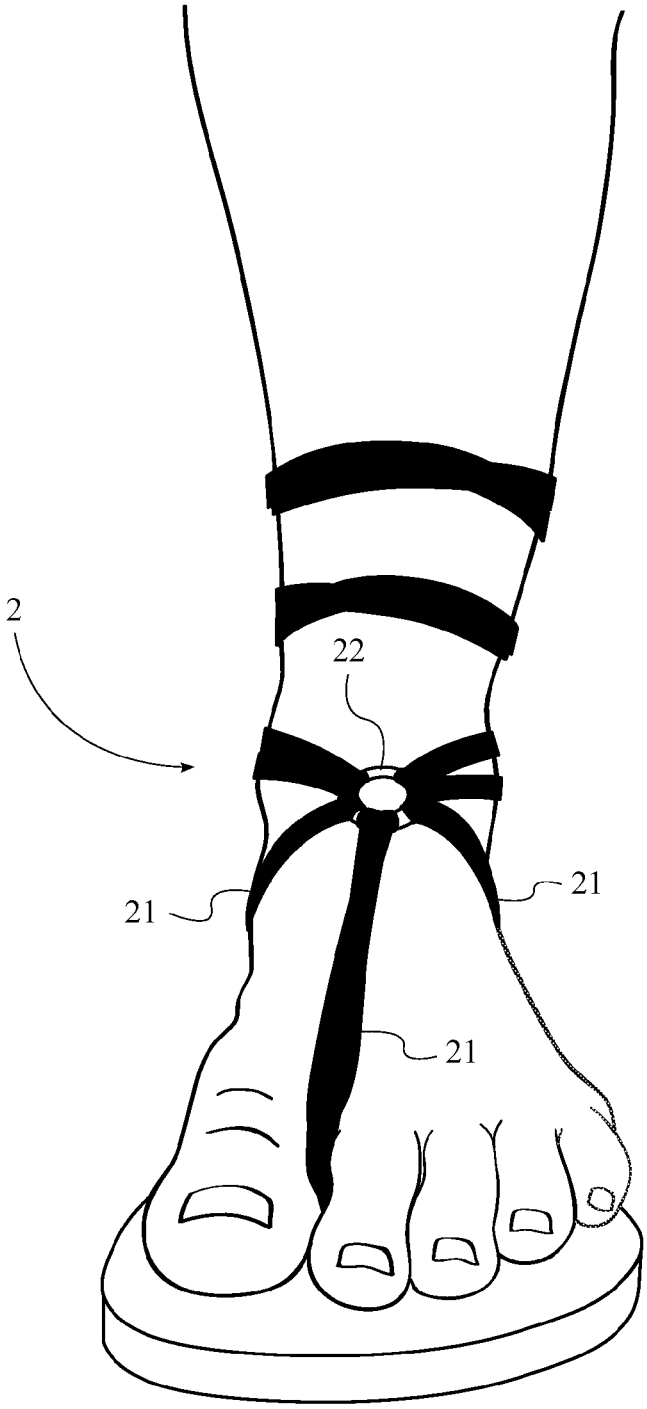
FIG. 5 is a front view of the present invention in use having a strap arrangement incorporating the strap tie ring.

Referring to FIGS. 4-5, the strap arrangement 2 comprises a plurality of straps 21 and a strap tie ring 22. The strap arrangement 2 is removably connected to the plurality of converter pegs 1. Each of the plurality of straps 21 is removably connected to the medial loop portion 123 of one of the plurality of converter pegs 1. Each of the plurality of straps 21 may be comprised of lengths of fabric, cord, string, or any other elongated strip of material the user may wish to utilize. The strap tie ring 22 is an optional accessory.

Figure 6:
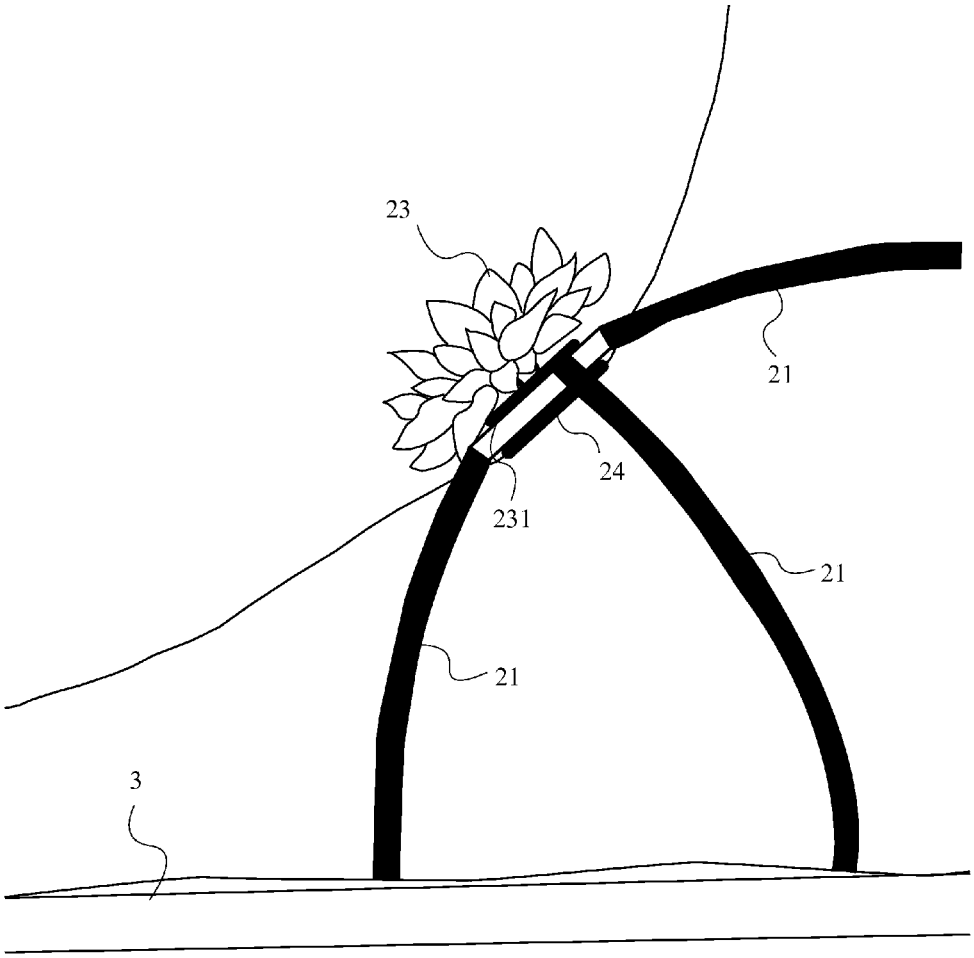
FIG. 6 is a side view of the present invention in use having a strap arrangement incorporating the strap tie ring, embellishment and embellishment connection magnet.

Referring to FIG. 6, the strap arrangement 2 further comprises a decorative embellishment 23 and an embellishment connection magnet 24, wherein the decorative embellishment 23 comprises a magnetic backing 231. The decorative embellishment 23 is a decorative object which adds aesthetic appeal to the visual appearance of the present invention, and may take virtually any form including, but not limited to, a flower, rhinestone, button, object, or any other desired shape. The plurality of straps 21 is removably connected to the strap tie ring 22. To create a customized strap arrangement 2, the user threads each of the plurality of straps 21 through the cord loop 12 of one of the plurality of converter pegs 1, places their foot atop the sandal sole 3, and proceeds to wrap the plurality of straps 21 around their foot and lower leg in any desired manner. The decorative embellishment 23 and the strap tie ring 22 are optional for creating the customized strap arrangement 2. The user may additionally incorporate rings, charms or other additional embellishments into the strap arrangement 2 as the user desires. For example, the user may arrange and thread the laces through the loops and around the foot in such a way that a ring may be held in place by the laces on the top of the foot near the instep If the user wishes to include the strap tie ring 22, the user simply threads one or more of the plurality of straps 21 through the strap tie ring 22 in any configuration the user desires. If the user wishes to include the decorative embellishment 23 in the customized strap arrangement 2, the user first positions the magnetic backing 231 concentrically with the strap tie ring 22, between the strap tie ring 22 and the user's foot. The user then positions the decorative embellishment 23 adjacent to the strap tie ring 22 that the embellishment connection magnet 24 is positioned adjacent to the strap tie ring 22 opposite the magnetic backing 231. The embellishment connection magnet 24 is thereby removably connected with the decorative embellishment 23 by the magnetic backing 231. In the preferred embodiment of the present invention, the embellishment connection magnet 24 and the magnetic backing 231 protrude toward each other within the strap tie ring 22 in order to close the gap due to separation by the strap tie ring 22 so that the embellishment connection magnet 24 and the magnetic backing 231 are in physical contact, ensuring a secure connection. In alternate embodiments of the present invention, the decorative embellishment 23 may be removably connected to the strap tie ring 22 by other means, such as, but not limited to, hook and loop tape, hooks, or snaps. In another embodiment, the strap tie ring 22 itself is magnetic and the magnetic backing 231 is not necessary.

To use the present invention to convert a typical pair of flip-flop sandals into a pair of customized sandals with a customized strap arrangement 2, the user cuts or otherwise removes an existing strap setup from a pair of typical flip-flop sandals, inserts the plurality of converter pegs 1 into the plurality of peg apertures 31, steps into the sandals and connects the strap arrangement 2 to the plurality of converter pegs 1 as previously described. The plurality of converter pegs 1 and the strap arrangement 2 are only connected to any given sandal sole 3 temporarily, as the strap arrangement 2 is the only means of preventing the plurality of converter pegs 1 from sliding out from the bottom of the sole. After the user unlaces or otherwise removes the strap arrangement 2, the user may easily remove the plurality of converter pegs 1 and subsequently install the present invention in a different sandal sole 3, to achieve a different look by using a sandal sole 3 with a different color or pattern, for example.

Although the invention has been explained in relation to its preferred embodiment, it is to be understood that many other possible modifications and variations can be made without departing from the spirit and scope of the invention as hereinafter claimed.

What is claimed is:

1. A customizable replacement strap converter system for flip flop sandals comprises:

a plurality of converter pegs;

a strap arrangement;

a sandal sole;

the sandal sole comprises a plurality of peg apertures;

each of the plurality of converter pegs comprises a top face, a peg portion, and a cord loop, wherein the peg portion is cylindrical;

the strap arrangement comprises a plurality of straps and a strap tie ring;

the plurality of converter pegs being removably inserted into the plurality of peg apertures; and the strap arrangement being removably connected to the plurality of converter pegs.

2. The customizable replacement strap converter system for flip flop sandals as claimed in claim 1 comprises:

the cord loop comprises a first loop end, a second loop end, and a medial loop portion;

the cord loop being oriented perpendicular to the top face;

the first loop end and the second loop end being positioned adjacent to each other;

the first loop end and the second loop end being attached to the top face; and the medial loop portion being positioned opposite the first loop end and the second loop end.

3. The customizable replacement strap converter system for flip flop sandals as claimed in claim 2, wherein each of the plurality of straps is removably connected to the medial loop portion of one the plurality of converter pegs.

4. The customizable replacement strap converter system for flip flop sandals as claimed in claim 1 comprises:

the peg portion being concentrically positioned with the top face;

the top face being positioned on the first peg portion.

5. The customizable replacement strap converter system for flip flop sandals as claimed in claim 1 comprises:

the plurality of peg apertures traversing through the sandal sole, wherein the plurality of peg apertures is positioned around the sandal sole according to a typical flip-flop sandal arrangement;

each of the plurality of peg apertures comprises a first aperture portion and a second aperture portion, wherein a first aperture diameter for the first aperture portion is smaller than a second aperture diameter for the second aperture portion;

the first aperture portion and the second aperture portion being concentrically positioned with each other; and the first aperture portion and the second aperture portion being positioned adjacent to each other.

6. The customizable replacement strap converter system for flip flop sandals as claimed in claim 1 comprises:

the strap arrangement further comprises a decorative embellishment and an embellishment connection magnet, wherein the decorative embellishment comprises a magnetic backing;

the plurality of straps being removably connected to the strap tie ring;

the decorative embellishment being positioned adjacent to the strap tie ring;

the magnetic backing being concentrically positioned with the strap tie ring;

the embellishment connection magnet being positioned adjacent to the strap tie ring opposite the decorative embellishment; and the embellishment connection magnet being removably connected with the decorative embellishment by the magnetic backing.

* * * * *